US005726664A

United States Patent [19]

Park et al.

[11] Patent Number: 5,726,664

[45] Date of Patent: Mar. 10, 1998

[54] END LAUNCHED MICROSTRIP OR STRIPLINE TO WAVEGUIDE TRANSITION WITH CAVITY BACKED SLOT FED BY T-SHAPED MICROSTRIP LINE OR STRIPLINE USABLE IN A MISSILE

[75] Inventors: Pyong K. Park, Agoura Hills, Calif.; Eric L. Holzman, Medford, N.J.

[73] Assignee: Hughes Electronics, Los Angeles, Calif.

[21] Appl. No.: 247,732

[22] Filed: May 23, 1994

[51] Int. Cl.[6] ..... H01Q 1/28; H01P 5/107

[52] U.S. Cl. ..... 343/705; 343/767; 343/772; 343/789; 333/26; 333/33

[58] Field of Search ..... 333/26, 33; 343/708, 343/705, 767, 770, 772, 789; 244/3.14, 3.19

[56] References Cited

U.S. PATENT DOCUMENTS

| | | | |
|---|---|---|---|
| 2,887,429 | 3/1959 | Sommers et al. . | |
| 2,942,263 | 6/1960 | Baldwin | 343/767 |
| 3,710,338 | 1/1973 | Munson | 343/769 X |
| 4,197,545 | 4/1980 | Favaloro et al. | 343/767 X |
| 5,198,786 | 3/1993 | Russell et al. . | |
| 5,414,394 | 5/1995 | Gamand et al. | 333/34 X |

FOREIGN PATENT DOCUMENTS

| | | | |
|---|---|---|---|
| 0 384 777 | 8/1989 | European Pat. Off. . | |
| 48950 | 8/1977 | Japan | 343/767 |
| 843042 | 6/1981 | U.S.S.R. | 333/21 A |

OTHER PUBLICATIONS

IEEE Transactions on Microwave Theory and Techniques, vol. 34, No. 3, Mar. 19867 New York US, pp. 321–327, Das et al. 'Excitation of waveguide by stripline–and microstrip–line–fed slots' *figure 1*.

Patent Abstracts of Japan vol. 6 No. 151 (E–124), 11 Aug. 1992 & JP–A–57 075002 (Hitachi Ltd.) 11 May 1982, *abstract*.

*Primary Examiner*—Benny T. Lee

*Attorney, Agent, or Firm*—Charles D. Brown; Wanda K. Denson-Low

[57] ABSTRACT

A low profile, compact microstrip-to-waveguide or stripline-to-waveguide transition. The end of the waveguide is terminated in a cavity backed slot defined in a groundplane formed on a dielectric substrate. The slot is excited by a microstrip or stripline conductor defined on the opposite side of the substrate. The conductor is terminated in a T-shaped junction including two opposed arms extending along the slot, each having a length equal to one-quarter wavelength at the center frequency of operation. A cavity covers the substrate on the conductor side, and is sized so that no cavity modes resonate in the frequency band of operation. The transition is matched by appropriate selection of the length of the slot and the length and position of the microstrip.

14 Claims, 3 Drawing Sheets

FIG. 1.
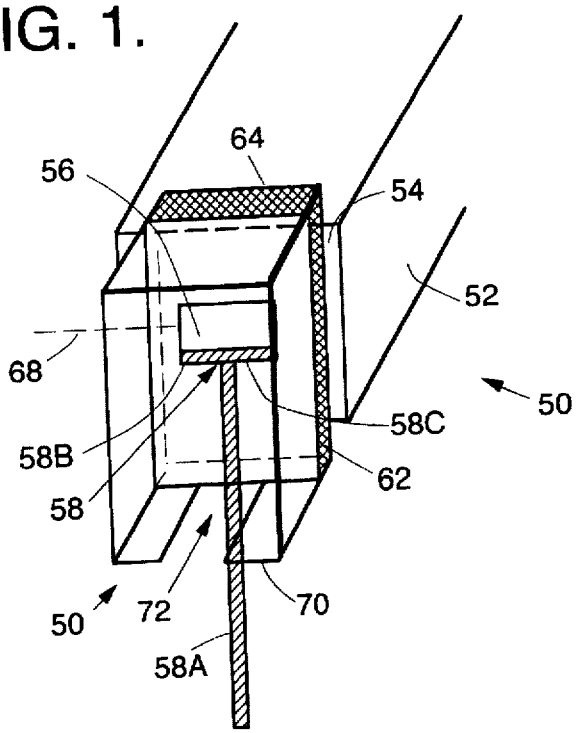
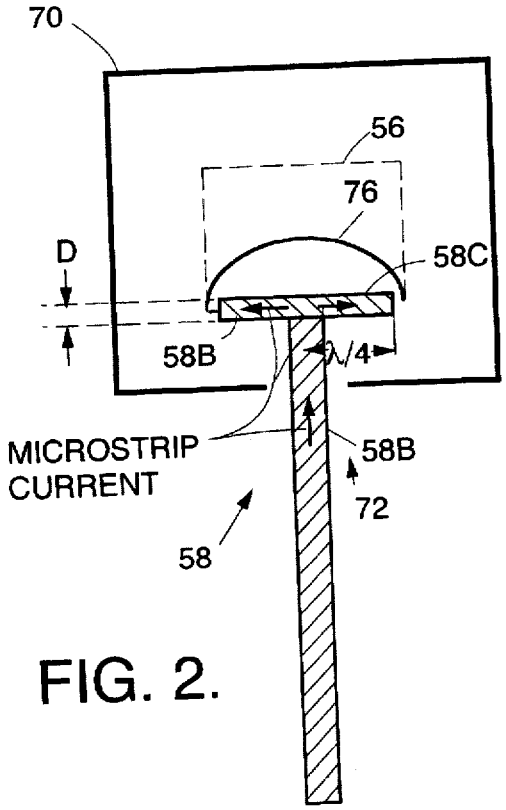
FIG. 2.

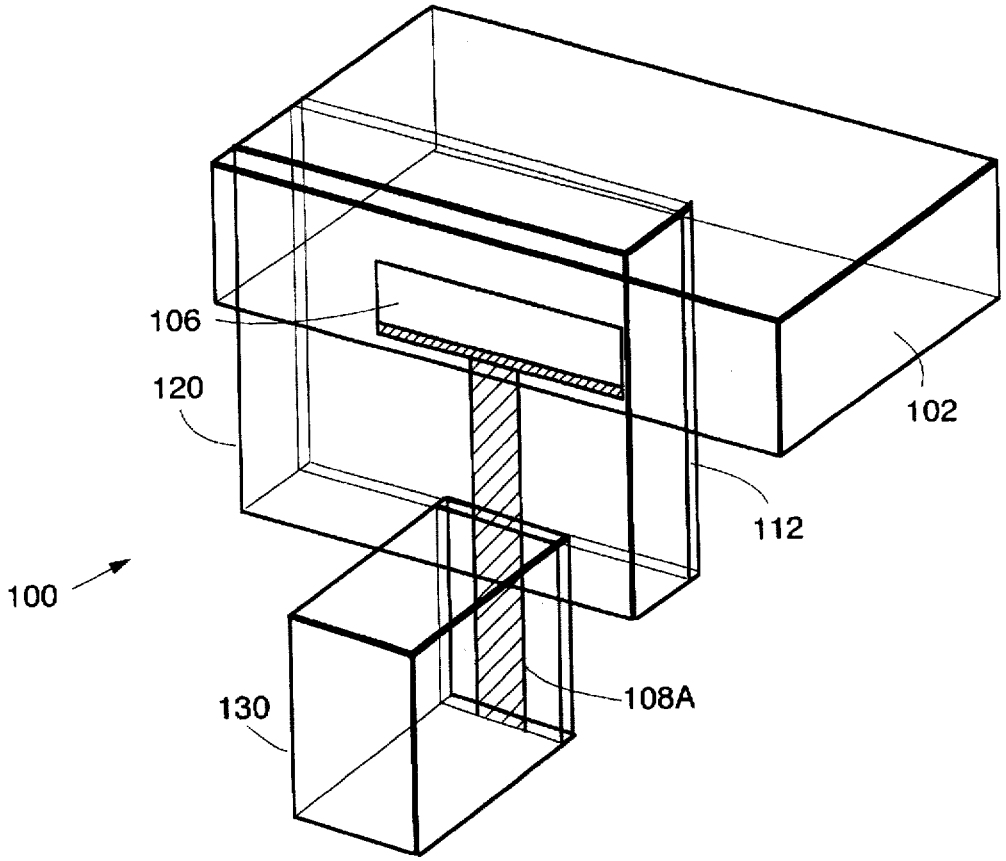
FIG. 3.
FIG. 4.
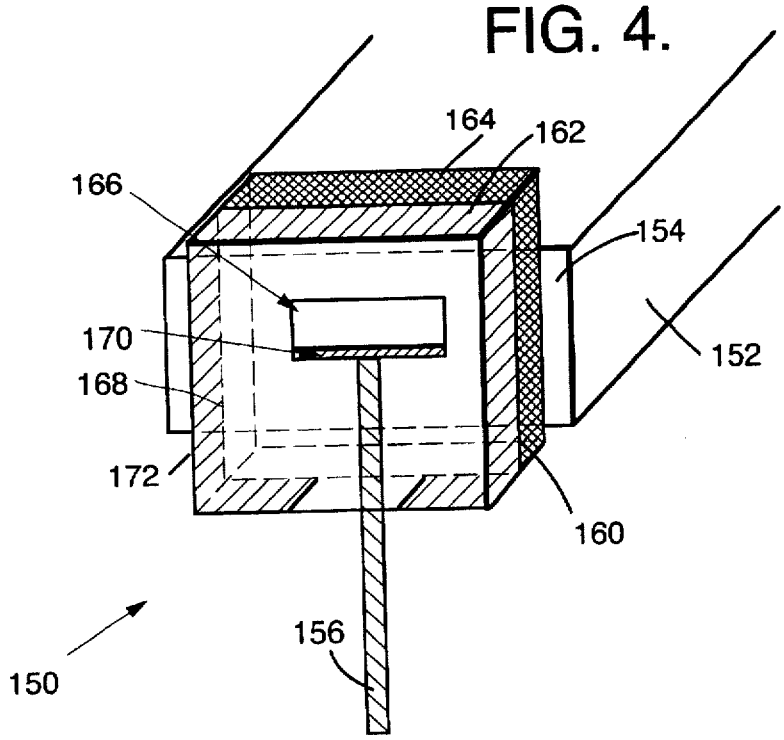

END LAUNCHED MICROSTRIP OR STRIPLINE TO WAVEGUIDE TRANSITION WITH CAVITY BACKED SLOT FED BY T-SHAPED MICROSTRIP LINE OR STRIPLINE USABLE IN A MISSILE

This invention was made with Government support awarded by the Government. The Government has certain rights in this invention.

TECHNICAL FIELD

This invention relates to transitions between a waveguide and a microstrip line or stripline.

RELATED APPLICATION

This application is related to commonly assigned application Ser. No. 08/247,363, filed May 23, 1994, "END LAUNCHED MICROSTRIP OR STRIPLINE TO WAVEGUIDE TRANSITION WITH CAVITY BACKED SLOT FED BY OFFSET MICROSTRIP LINE USABLE IN A MISSILE" by P. K. Park and E. Holzman.

BACKGROUND OF THE INVENTION

Microstrip-to-waveguide transitions are needed often in microwave applications, e.g., radar seekers. Modern millimeter wave radars and phased arrays have a need for a compact, easy to fabricate high performance transition. Usually, the antenna and its feed are built from rectangular waveguide, and the transmitter and receiver circuitry employ planar transmission lines such as microstrip line or stripline. The microstrip-to-waveguide transition plays a critical role in that it must smoothly (i.e., with minimal RF energy loss) transfer the energy between the transmitter or receiver and the antenna. Traditional microstrip-to-waveguide transitions are bulky, and they require that the microstrip line directly couple with the waveguide by penetrating its broadwall; such transitions are not very compatible with the thin planar structures of state-of-the-art radars.

The conventional microstrip-to-waveguide transition employs a microstrip probe, and is difficult to fabricate because the microstrip probe must be inserted into the middle of the waveguide. A hole must be cut in the waveguide wall for the probe to penetrate. A backshort must be positioned precisely behind the probe, about one-quarter wavelength. Fabricating the transition with the backshort placed accurately is difficult. Furthermore, the transition does not provide a hermetic seal, and it is difficult to separate the waveguide structure which leads to the antenna and the microstrip. A separate set of flanges must be built into the antenna to allow separation of the antenna and transmitter/receiver.

Another type of transition is the end launched microstrip loop transition. This transition is difficult to fabricate because the end of the loop must be attached physically to the waveguide broadwall. It is difficult to position the substrate precisely and to hold it in place securely. There is no hermetic seal, and also to separate the waveguide and microstrip line requires breaking the microstrip line for this transition. Further, the substrate is aligned parallel to the waveguide axis instead of perpendicular; such a configuration does not lend itself well to constructing compact layered phased arrays.

SUMMARY OF THE INVENTION

A compact microstrip-to-waveguide transition is described, and comprises terminating elements for terminating an end of the waveguide. The terminating elements comprise a dielectric substrate having opposed first and second surfaces, wherein a layer of conductive material defines a groundplane on a first surface thereof facing the interior of the waveguide. The conductive layer has an open slot defined therein characterized by a slot centerline. A microstrip conductor is defined on the second opposed surface, transverse to the slot. The microstrip conductor terminates in a T-shaped microstrip junction comprising first and second opposed arms, which extend from an end of the microstrip conductor parallel to the length of the slot. The arms have an effective microstrip electrical length substantially one-quarter wavelength at a center frequency of operation of the transition.

A conductive cavity covers the microstrip conductor side of the terminating elements, and is sized to prevent cavity modes from resonating in the frequency band of operation.

The dimensions and placement of the slot and placement of the microstrip conductor are selected to match the respective waveguide and microstrip characteristic impedances. For example, the slot width is preferably at least one third the waveguide height. The edge of the T-shaped microstrip junction is flush with a longitudinal edge of the slot.

BRIEF DESCRIPTION OF THE DRAWING

These and other features and advantages of the present invention will become more apparent from the following detailed description of an exemplary embodiment thereof, as illustrated in the accompanying drawing, in which:

FIG. 1 is a simplified isometric view of a T-shaped microstrip-to-waveguide transition in accordance with this invention.

FIG. 2 is a schematic diagram illustrating the sinusoidal electric field profile excited by the microstrip line of the transition.

FIG. 3 is a simplified isometric view of an exemplary embodiment of the transition.

FIG. 4 shows an exemplary waveguide to stripline transition in accordance with the invention.

DETAILED DESCRIPTION OF THE PREFERRED EMBODIMENT

Figure 5:
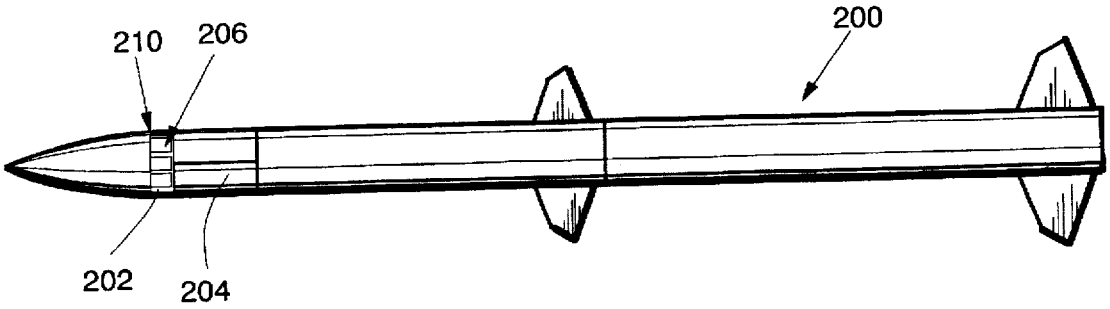
FIG. 5 shows a simplified illustration of an air-to-air missile having an RF processor including a transition in accordance with the invention.

This invention is a low profile, compact microstrip-to-waveguide transition which utilizes electromagnetic coupling instead of direct coupling. An exemplary embodiment of a transition 50 for transitioning between a rectangular waveguide 52 and a microstrip line is shown in FIG. 1. The end 54 of the waveguide 52 is terminated in a cavity backed slot 56 which is excited by a T-shaped microstrip line junction 58 comprising microstrip conductor 58A and arms 58B and 58C. The slot 56 and microstrip line junction 58 and microstrip conductor 58A are etched on the opposite sides of a dielectric substrate 62, fabricated of a dielectric material such as quartz. Thus, in the conventional manner, the opposite sides of the substrate 62 are initially covered with a thin film of conductive material such as copper. Using conventional thin-film photolithographic etching techniques, the dimensions of the slot and microstrip and their positions can be fabricated precisely, easily and inexpensively. The slot 56 is defined by removing the thin copper layer 64 within the slot outline. The layer 64 extends across the end of the waveguide. To define the microstrip line junction 58, the thin conductive layer is removed everywhere except for the material defining the microstrip conductor. A backshort placed one-quarter wavelength behind the microstrip line (required in conventional transitions) is not required in this transition.

In this embodiment, the slot 56 is centered on the end 54 of the waveguide 52, in that the center axis 68 of the slot is coincident with a center line parallel to the long dimension of the waveguide end which places the slot centered along the short dimension of the waveguide 52. The slot is also centered along the long dimension of the waveguide. This placement will depend on the type of waveguide for which the particular transition is designed. For example, the slot will be centered at the end of a circular waveguide. The microstrip conductor 58A is disposed transversely to the slot center axis 68.

In the typical application, the substrate 62 comprises a portion of a larger substrate, in turn comprising a larger microwave circuit comprising a plurality of microstrip lines defined on the substrate, and with other waveguides having their own transition in the same manner as illustrated for waveguide 52 and transition 50.

When the microstrip conductor 58A is excited, currents flow in the microstrip line 58 and the ground plane 64 directly below it. If a slot is cut in the ground plane in the path of the microstrip line junction, e.g., slot 56, the current is disturbed, and an electric field is excited in the slot 56 having a magnitude distributed as shown by curve 76, as shown in FIG. 2. The input microstrip current (indicated by the arrows in FIG. 2) flows into the two arms 58B and 58C of the microstrip line junction 58. Each arm is about one-quarter wavelength long, so an RF open-circuit at the end of the arm transforms to an RF short circuit at the junction. Thus, maximum current flows at the junction of the T while no current flows at the end of each arm. This current amplitude profile over the length of the arms 58B, 58C of the T-shaped microstrip line junction 58 excites a similar electric field profile in the slot 56. The invention employs electromagnetic coupling between the edge of the T and the edge of the slot. If the end of a rectangular or circular waveguide is placed adjacent to the slot, as shown in FIG. 1, the microstrip energy will couple to the slot electric field and into the waveguide. The transition 50 exploits this energy transfer property.

The slot 56 also can couple the microstrip energy to unwanted modes such as the parallel-plate and dielectric surface wave modes; such energy would be wasted in that it does not couple to the waveguide and increases the transition energy loss. Moreover, in the event the transition is used in a larger, more complex circuit employing a plurality of similar microstrip to waveguide transitions, there can be interference between transitions.

To eliminate the coupling to these unwanted modes, a rectangular cavity 70 can be used to cover the transition on the side of the microstrip line junction 58, as seen in FIG. 2, for example. The cavity 70 is essentially a four sided electrically conductive enclosure, having a closed end parallel to the substrate 62 of FIG. 1. The cavity 70 includes a small opening 72 (seen in FIGS. 1 and 2) defined about the microstrip transmission line to permit the line 58A to exit the cavity without shorting to the cavity walls as seen in FIG. 1. If the opening maintains a width equal to about three times the width of the line, typically no capacitive loading will occur. Smaller openings may require use of known measures to adjust for the effects of the capacitance. The cavity dimensions must be chosen so that no cavity modes resonate in the transition's frequency band of operation. The selection of cavity dimensions to accomplish this function is well known in the art.

To maximize the amount of energy transferred from the microstrip line junction 58 to the waveguide 52, the transition 50 is matched by appropriate selection of the length and width of the slot, the length and width of the arms 58B, 58C of the microstrip line junction 58, and the T penetration depth into the slot. The T penetration depth D (FIG. 2) measures the overlap of the arms 58B, 58C over the slot 56. Typical waveguide characteristic impedances are of the order of 100 to 350 ohms depending on the waveguide height. On the other hand, the characteristic impedance of the microstrip line is usually 50 ohms for most applications. One way to match these impedances is to use quarter wavelength impedance transformers on either the microstrip side or the waveguide side or both. These transitions add length and complexity to the transition. This invention eliminates the need for these transformers by taking advantage of the natural transforming characteristics of the slot.

FIG. 2 shows the electric field profile 76 of the slot 56 when its length is resonant. The slot length is resonant when the input impedance seen at the slot centerline 68 is pure real valued. This resonant behavior is well understood: the voltage profile along the slot is sinusoidal, while the current remains constant. Thus, the first step in the design of the transition is to determine the resonant length of the slot 56 at the center frequency of operation. The impedance of the slot measured at the slot centerline or at any multiple of a half wavelength from the centerline will be purely real at the resonant length. Next, the length of each arm 58B, 58C is set to be roughly one-quarter microstrip wavelength at the transition's center frequency of operation. The characteristic impedance of each arm should be about 100 ohms since the junction impedance of the microstrip line junction 58 is 50 ohms. The slot width should be wide enough so that there is no interaction between the far edge of the slot and the microstrip line junction. It has been found that a width of at least one third of the waveguide height is sufficient; making the slot 56 any wider has a negligible effect on the match.

The penetration depth D of the arms 58B and 58C over the slot is a very sensitive parameter. The match is very dependent on the fringing of a portion of the slot electric field through the substrate 62 to the microstrip T junction 58. As the penetration depth changes, so do the fringing fields. The best results have been achieved when the upper edge 58D of the T junction 58 is nearly flush, i.e., within a few mils, with the lower edge 56A of the slot 56 as seen in FIG. 2, for example.

The transition can be constructed without the cavity 70 backing the slot, and it can still be matched to the waveguide and operate well. However, if the transition is part of a more complex assembly including a plurality of transitions, then energy from one transition can interfere with energy from another transition. If, however, such isolation is not required in a particular application, the transition can omit the cavity 70.

FIG. 3 is a simplified line drawing of an exemplary embodiment of a Ka-band half-height-waveguide-to-microstrip transition 100 in accordance with the invention. The waveguide 102 has a rectangular cross-sectional configuration which is 70 by 280 mils. The quartz substrate 112 is 200 by 186 mils, with a thickness of 10 mils. The slot 106 is centered within the end of the waveguide, and is 124 mils in length by 30 mils in width. The microstrip conductor 108A is 21.4 mils in width, and the microstrip line junction is 108 mils wide, with a width of 5 mils. The cavity 120 has a depth of 60 mils. A channel 130 for the microstrip line is provided, which is 99 mils high, by 130 mils deep, and 65 mils wide.

FIG. 4 shows a waveguide to stripline transition 150 for transitioning between a rectangular waveguide 152 and a stripline, employing a stripline T junction with a cavity (172) backed slot 166. This transition is similar to the microstrip to waveguide transition 50 of FIG. 1, except that the stripline conductor 156 is sandwiched between two layers of dielectric. As in the transition 50, a dielectric substrate 160 is disposed at the end 154 of the waveguide 152. The substrate surface facing the interior of the waveguide is covered with a conductive layer 164, in which the slot 166 is defined by selectively removing the conductive layer within the slot outlines. On the opposite surface 168 of the substrate 160, the stripline conductor 156 and T junction 170 is defined by selectively removing the conductive layer covering the surface. In contrast to the waveguide to microstrip transition 50, the transition 150 includes a layer of dielectric 162 adjacent the stripline conductor surface 168 of the first substrate 160, so that the surface 168 is sandwiched between the dielectric substrate 160 and the dielectric layer 162.

Figure 6:
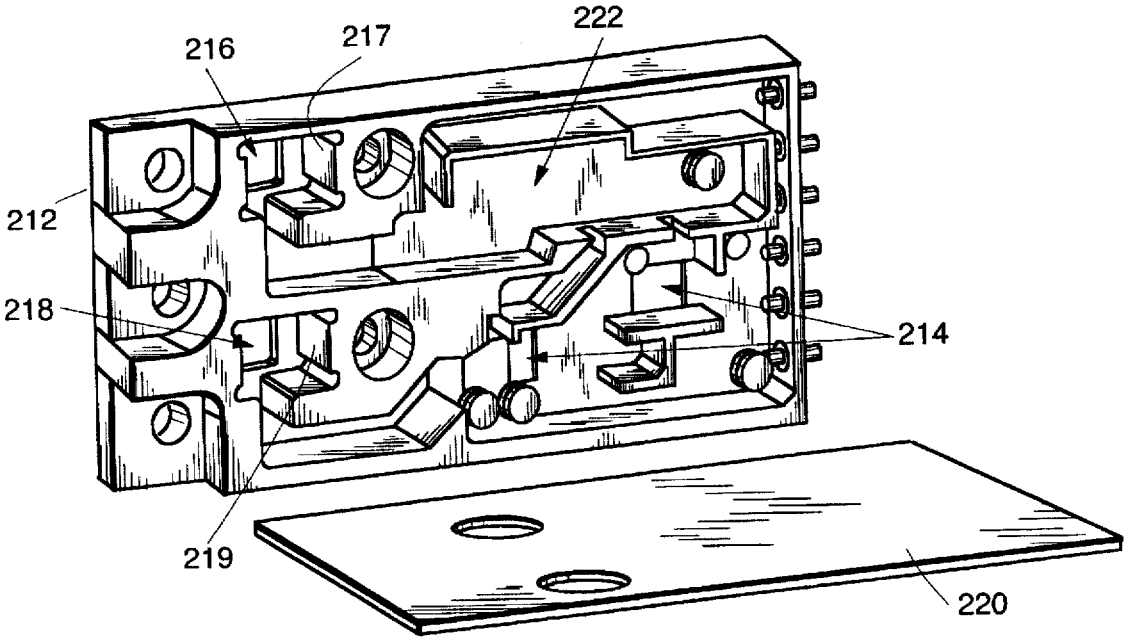
FIG. 6 shows a simplified RF processor of the missile of FIG. 5.

One particular application to which the invention can be put to use is in the RF processor of a missile, e.g., an air-to-air missile having a seeker head to guide the missile to a target. One such missile 200 is shown in simplified form in FIG. 5. The missile includes an antenna section 202, a transmitter section 204, a receiver module 210 including an RF processor, and a seeker/servo section 206. The receiver module is shown in further detail in FIG. 6, and includes a module chassis 212 which supports several active devices including low noise amplifiers 214. The module includes an LO input port 216 and a receive signal port 218. The LO and receive signals are delivered to the respective ports via waveguides (not shown) connected at the back side of the housing. A quartz substrate (not shown) carries microstrip or stripline circuitry (not shown in FIG. 6) used to define the waveguide to microstrip transition or waveguide to stripline transition in accordance with the invention. The cavity backing the transition is defined by sides of the chassis channel 217 and 219 and the module cover 220. In this example, the microstrip or stripline conductor leading away from the LO port 216 is connected to a mixer/control circuit located in area 222 of the chassis, and the microstrip or stripline conductor leading away from the receive signal port 218 is connected to the low noise amplifiers 214. The receiver module 210 is sealed hermetically at the two input ports 216 and 218 by the quartz substrate covering the port openings and being sealed to the chassis around the perimeter of the openings. The particulars of the waveguide to microstrip or stripline transitions are as shown in FIG. 1 and FIG. 4.

Current trends in RF seeker design emphasize the reduction of cost and volume while achieving high performance. For millimeter wave radars and phased radars, the packaging of the seeker is a significant problem. In some cases, although the components can be designed and built, they all cannot be placed physically within the seeker envelope. To integrate the antenna with the transmitter/receiver circuitry is a difficult task with conventional, bulky microstrip-to-waveguide transitions. A typical active phased array can easily require hundreds of these transitions. This invention provides tremendous cost savings and volume reduction and can make presently unrealizeable radar designs feasible.

This invention provides a low profile end launched microstrip-to-waveguide transition which has the following advantages compared to existing microstrip-to-waveguide transitions:

1. A microstrip line does not have to penetrate the waveguide.

2. A backshort does not have to be placed one-quarter wavelength behind the microstrip line.

3. The transition is compact and easy to fabricate from a single piece of dielectric substrate.

4. The transition is compatible with the planar structure of standard transmitter and receiver modules used in phased arrays.

5. Often, to physically separate the antenna and transmitter or receiver assemblies is necessary for testing of the components. Performing this separation with conventional transitions usually requires that one break the microstrip line. This transition provides a natural flat surface (the substrate 58 with the slot in FIG. 1) to easily separate the assemblies without breaking any circuitry.

6. The transition substrate 62 or 160 automatically creates a hermetic seal for the transmitter and receiver assemblies, typically located on a microstrip circuit board. In particular, the receiver circuit typically has delicate wire bonding and active semiconductor elements which need the protective hermetic seal against corrosion.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A low profile, compact stripline transmission line to waveguide transition, employing electromagnetic coupling, comprising:

a waveguide having a first end and characterized by a waveguide characteristic impedance;

terminating means for terminating said first end of said waveguide, said terminating means comprising a dielectric substrate having opposed first and second surfaces, wherein a layer of conductive material is defined on said first opposed surface thereof facing an interior region of said waveguide, said conductive layer having an open slot defined therein, and a stripline conductor defined on said second opposed surface disposed transversely relative to a longitudinal extent of said slot, said longitudinal extent of said slot smaller than a corresponding longitudinal extent of said first end of said waveguide, a dielectric layer disposed adjacent the stripline conductor such that the conductor is sandwiched between said dielectric layer and said substrate, said conductor terminating in a stripline T junction comprising first and second opposed arms disposed along said slot, said arms having an effective stripline electrical length substantially equal to one-quarter wavelength at a transition frequency of operation, said arms and stripline conductor electrically insulated from said conductive layer on said first opposed surface; and means for defining a conductive cavity behind said second opposed surface to cover said dielectric layer and to prevent coupling to unwanted parallel-plate and dielectric surface wave modes, said defining means including an end conductive surface and cavity side enclosure surface means for defining conductive sidewalls enclosing sides of said cavity, said conductive cavity enclosing said conductor at a region adjacent said second surface, and wherein dimensions of said cavity are such that no cavity modes resonate in a frequency band of operation of said transition, said stripline conductor, dielectric substrate and said conductive layer comprise a stripline transmission line characterized by a stripline characteristic impedance, and wherein said length of said arms, placement of said slot and placement of said stripline conductor are such that said transition is matched to said waveguide characteristic impedance and said stripline line characteristic impedance.

2. The transition of claim 1 wherein said waveguide is a rectangular waveguide, and said means for defining a conductive cavity defines a rectangular cavity.

3. The transition of claim 1, wherein said slot has a slot width dimension along a waveguide height dimension which is at least one third said waveguide height dimension.

4. The transition of claim 1 wherein said stripline T junction comprises an edge which lies slightly inside a longitudinal perimeter edge of said slot.

5. A microstrip-line-to-waveguide transition, comprising:

a waveguide having a first end and characterized by a waveguide characteristic impedance;

terminating means for terminating said first end of said waveguide, said terminating means comprising a dielectric substrate having opposed first and second surfaces, wherein a layer of conductive material is defined on said first opposed surface thereof facing an interior region of said waveguide, said conductive layer having an open slot defined therein, and a microstrip conductor defined on said second opposed surface disposed transversely relative to a longitudinal extent of said slot, said longitudinal extent of said slot smaller than a corresponding longitudinal extent of said first end of said waveguide, said microstrip conductor terminating in a T-shaped microstrip junction at said slot, said junction comprising first and second opposed arms extending transverse to said microstrip conductor and along said slot, said arms having an effective microstrip electrical length of substantially one-quarter wavelength at a transition frequency of operation, said arms and microstrip conductor electrically insulated from said conductive layer defined on said first opposed surface, said microstrip conductor, dielectric substrate and said conductive layer define a microstrip transmission line characterized by a microstrip characteristic impedance, and wherein said length of said arms, placement of said slot and placement of said microstrip conductor are such that said transition is matched to said waveguide characteristic impedance and said microstrip line characteristic impedance; and means for defining a conductive cavity adjacent said second opposed surface and backing said slot to cover said second surface of said substrate and to prevent coupling to unwanted parallel-plate and dielectric surface wave modes, said defining means including an end conductive surface and cavity side enclosure surface means for defining conductive sidewalls enclosing sides of said cavity, said conductive cavity enclosing said microstrip conductor at a region adjacent said second surface, and wherein dimensions of said cavity are such that no cavity modes resonate in a frequency band of operation of said transition.

6. The transition of claim 5 wherein said waveguide is a rectangular waveguide, and said means for defining a conductive cavity defines a rectangular cavity.

7. The transition of claim 6 wherein said T-shaped microstrip junction comprises an edge which is essentially flush with a longitudinal edge of said slot.

8. The transition of claim 7, wherein said slot has a slot width dimension aligned along a waveguide height dimension which is at least one third of said waveguide height dimension.

9. An airborne missile, comprising a missile body, a waveguide disposed in said body and having a first end and characterized by a waveguide characteristic impedance, an RF processor section disposed within said body, said processor section including a microstrip circuit, a port for coupling to said waveguide, and a microstrip transmission line to waveguide transition disposed at said port, said transition comprising terminating means for terminating said first end of said waveguide, said terminating means comprising a dielectric substrate having opposed first and second surfaces, wherein a layer of conductive material defines a groundplane on said first opposed surface thereof facing an interior region of said waveguide, said conductive layer having an open slot defined therein, and a microstrip conductor defined on said second opposed surface and transverse to a longitudinal extent of said slot, said longitudinal extent of said slot smaller than a corresponding longitudinal extent of said waveguide end, said conductor terminating in a T-shaped microstrip junction comprising first and second opposed arms, said arms extending from an end of said microstrip conductor and along said slot, said arms having an effective microstrip electrical length substantially one-quarter wavelength at a frequency of operation of said transition, said arms and microstrip conductor electrically insulated from said conductive layer on said first opposed surface, said microstrip conductor, dielectric substrate and said conductive layer define a microstrip transmission line characterized by a microstrip characteristic impedance, and wherein said length of said arms, placement of said slot and placement of said microstrip conductor are such that said transition is matched to said waveguide characteristic impedance and said microstrip line characteristic impedance, and means for defining a conductive cavity adjacent said second surface of said substrate and backing said slot to cover said second surface and to prevent coupling to unwanted parallel-plate and dielectric surface wave modes, said defining means including an end conductive surface and cavity side enclosure surface means for defining conductive sidewalls enclosing sides of said cavity, said conductive cavity enclosing said microstrip conductor at a region adjacent said second surface, and wherein dimensions of said cavity are such that no cavity modes resonate in a frequency band of operation of said transition.

10. The missile of claim 9 wherein said T-shaped microstrip junction comprises an edge which lies slightly inside a longitudinal perimeter edge of said slot.

11. The missile of claim 9, wherein said slot has a slot width dimension aligned along a waveguide height dimension which is at least one third of said waveguide height dimension.

12. An airborne missile, comprising a missile body, a waveguide disposed in said body and having a first end and characterized by a waveguide characteristic impedance, an RF processor section disposed within said body, said processor section including a stripline transmission line circuit, a port for coupling to said first end of waveguide, and a compact stripline transmission line to waveguide transition disposed at said port, said transition comprising terminating means for terminating said first end of said waveguide located at said port, said terminating means comprising a dielectric substrate having opposed first and second surfaces, wherein a layer of conductive material defines a groundplane on a first surface thereof facing the interior of said waveguide, said conductive layer having an open slot defined therein, and a stripline conductor defined on said second opposed surface disposed transversely relative to said slot, a dielectric layer disposed adjacent the stripline conductor such that the stripline conductor is sandwiched between said dielectric layer and said substrate, said stripline conductor terminating in a stripline T junction comprising first and second opposed arms extending from an end of said stripline conductor along a longitudinal extent of said slot, said longitudinal extent of said slot smaller than a corresponding longitudinal extent of said first end of said waveguide, said arms each having an effective electrical length of substantially one-quarter wavelength at a transition frequency of operation, said arms and stripline conductor electrically insulated from said conductive layer on said first opposed surface, and means for defining a conductive cavity adjacent said second opposed surface to cover said dielectric layer and to prevent coupling to unwanted parallel-plate and dielectric surface wave modes, said defining means including an end conductive surface and cavity side enclosure surface means for defining conductive sidewalls enclosing sides of said cavity, said conductive cavity enclosing said conductor at a region adjacent said second surface, and wherein dimensions of said cavity are such that no cavity modes resonate in a frequency band of operation of said transition, said stripline conductor, dielectric substrate and said conductive layer comprise a stripline transmission line characterized by a stripline characteristic impedance, and wherein said length of said arms, placement of said slot and placement of said stripline conductor are such that said transition is matched to said waveguide characteristic impedance and said stripline line characteristic impedance.

13. The missile of claim 12, wherein said slot has a slot width dimension aligned along a waveguide height dimension which is at least one third of said waveguide height dimension.

14. The missile of claim 12 wherein said stripline T junction comprises an edge which lies slightly inside a longitudinal perimeter edge of said slot.

* * * * *